US006299074B1

(12) United States Patent
Cooke

(10) Patent No.: US 6,299,074 B1
(45) **Date of Patent: *Oct. 9, 2001**

(54) FUEL INJECTOR

(75) Inventor: Michael P Cooke, Gillingham (GB)

(73) Assignee: Lucas Industries plc (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/203,709

(22) Filed: Dec. 2, 1998

(30) Foreign Application Priority Data

Dec. 6, 1997 (GB) ..... 9725804

(51) Int. Cl.[7] ..... B05B 1/08

(52) U.S. Cl. ..... 239/102.2; 239/533.3; 239/533.8; 239/533.9; 239/585.1

(58) Field of Search ..... 239/88, 95, 96, 239/533.2, 533.3, 533.8, 533.9, 585.1, 102.1, 102.2; 251/30.01, 129.06

(56) References Cited

U.S. PATENT DOCUMENTS 4,327,688 * 5/1982 Lowther ..... 239/87
4,584,980 * 4/1986 Weiger et al. ..... 251/30.01
4,725,002 * 2/1988 Trachte ..... 239/102.2
4,826,080 * 5/1989 Ganser ..... 239/88
5,011,082 * 4/1991 Ausiello et al. ..... 239/533.2
5,419,492 * 5/1995 Gant et al. ..... 239/88
5,673,669 * 10/1997 Maley et al. ..... 239/96
5,810,255 * 9/1998 Itoh et al. ..... 239/102.2
5,860,597 * 1/1999 Tarr ..... 239/88

FOREIGN PATENT DOCUMENTS 195 19 192 6/1996 (DE) .
0 767 304 4/1997 (EP) .

* cited by examiner

*Primary Examiner*—David A. Scherbel
*Assistant Examiner*—Christopher S. Kim
(74) *Attorney, Agent, or Firm*—Andrus, Sceales, Starke & Sawall

(57) ABSTRACT

A fuel injector comprises a valve needle slidable in a bore and moveable under the influence of the fuel pressure within a control chamber defined, in part, by a surface associated with the needle, and a piezoelectrically actuated valve controlling the fuel pressure within the control chamber. The control chamber may be supplied with fuel through a passage provided in the valve needle.

6 Claims, 3 Drawing Sheets

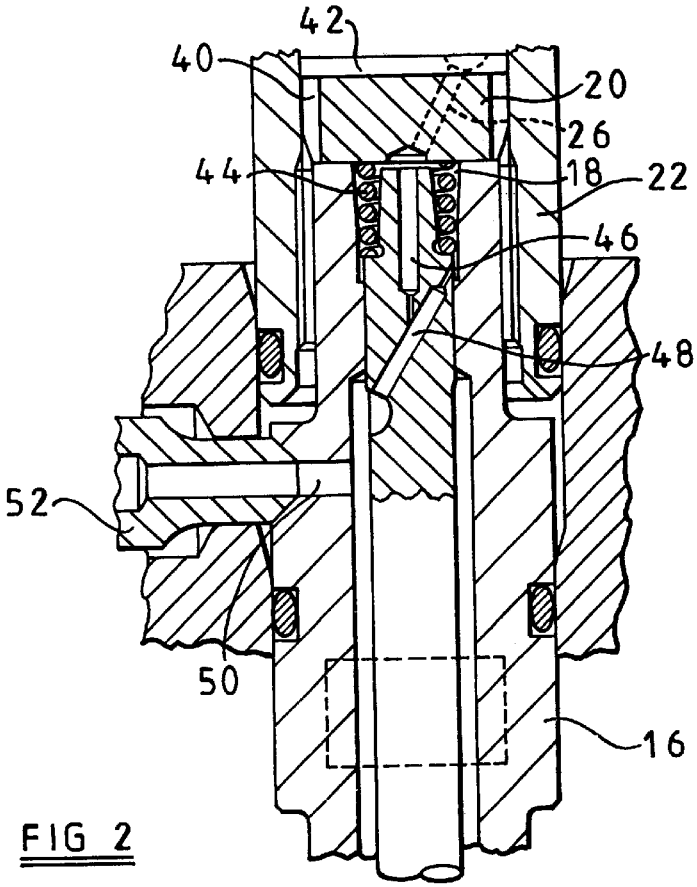
FIG 2
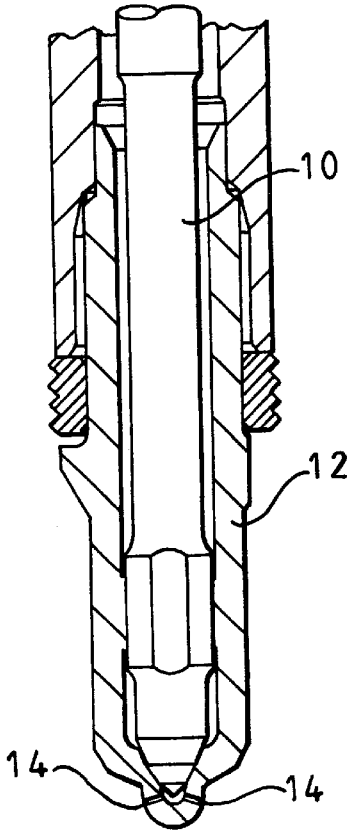

FUEL INJECTOR

This invention relates to a fuel injector for use in supplying fuel under pressure to a cylinder of an associated compression ignition internal combustion engine. In particular, the invention relates to an injector suitable for use in a fuel system of the type in which an accumulator or common rail is charged with fuel by a high pressure fuel pump, a plurality of individually actuable injectors being arranged to receive fuel from the accumulator or common rail.

EP-A-0767304 describes an injector suitable for use in such a fuel system. The injector comprises a valve needle which is engageable with the seating. Part of the valve needle is exposed to the fuel pressure within a control chamber, the pressure of fuel within the control chamber controlling movement of the needle. An electromagnetically actuated valve is provided to control the fuel pressure within the control chamber.

It is desirable, for example where the injector is to be used with a four valve cylinder head, to use an injector of relatively small diameter. Injectors including electromagnetically actuated control valves are generally of relatively large diameter as the electromagnetic actuators are relatively large.

According to a first aspect of the invention there is provided an injector comprising a valve needle slidable in a bore and moveable under the influence of the fuel pressure within a control chamber defined, in part, by a surface associated with the needle, and a piezoelectrically actuated valve controlling the fuel pressure within the control chamber.

The use of a piezoelectrically actuated valve rather than an electromagnetically actuated valve permits the diameter of the injector to be reduced as piezoelectric actuators of small dimensions are available.

One disadvantage of using a piezoelectric actuator is that the length of the piezoelectric element can vary, in use, due to temperature, wear and drift by an amount of the same order as is achieved when an electric field is applied to the material, in use. In order to compensate for such changes, the piezoelectrically actuated valve conveniently comprises a valve member and a piezoelectric actuator, the piezoelectric actuator including a piezoelectric element spring biased towards the valve member, and a damping arrangement damping movement of the piezoelectric element under the action of the spring.

In such an arrangement, the spring causes movement of the piezoelectric element to compensate for changes in the length of the piezoelectric element, the damping arrangement limiting the rate at which the spring moves the piezoelectric element so that the rapid changes in length caused by applying an electric field to the piezoelectric element to allow movement of the valve member are not compensated for by the action of the spring.

According to another aspect of the invention there is provided a fuel injector comprising a valve needle slidable in a bore and moveable under the influence of the fuel pressure within a control chamber defined, in part, by a surface associated with the needle, and a control valve arranged to control the fuel pressure within the control chamber, wherein the control chamber is supplied with fuel through a passage provided in the valve needle.

By supplying fuel to the control chamber through a passage provided in the valve needle rather than a passage provided in a housing within which the needle is slidable, the diameter of the housing, and hence the injector, can be reduced.

The invention will further be described, by way of example, with reference to the accompanying drawings, in which:

FIG. 2 is an enlargement of part of FIG. 1; and

Figure 1:
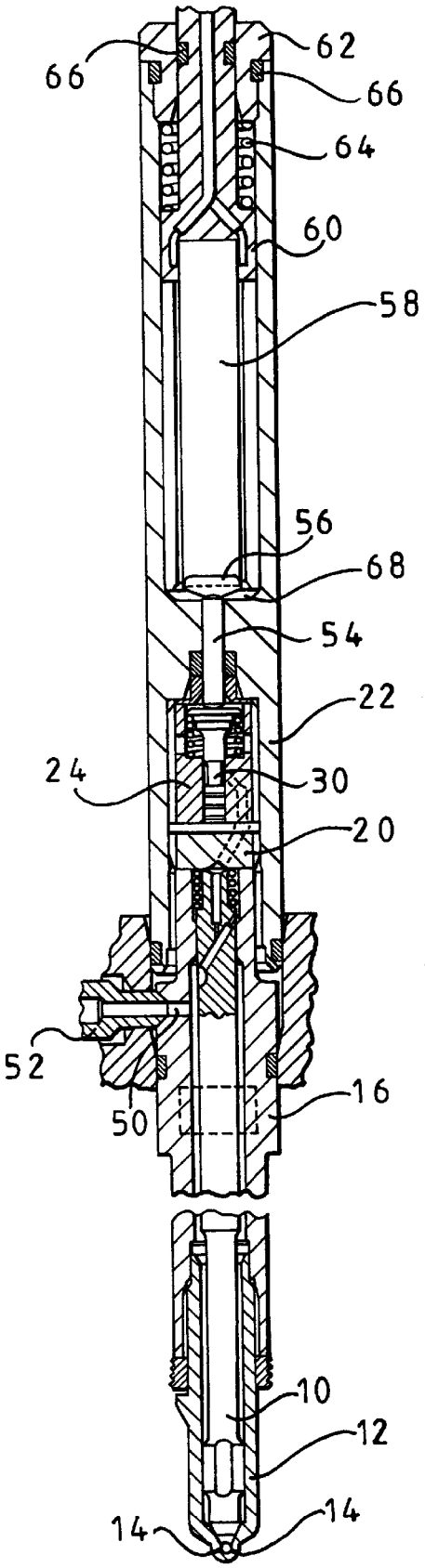
FIG. 1 is a sectional view illustrating an injector in accordance with an embodiment of the invention.

The injector illustrated in the accompanying drawings comprises a valve needle 10 which is slidable within a bore formed in a nozzle body 12. The bore of the nozzle body 12 is a blind bore, and adjacent the blind end of the bore, a frusto-conical valve seating is formed with which an end portion of the needle 10 is engageable to control the flow of fuel, in use, past the seating towards a plurality of small outlet openings 14 provided in the nozzle body 12. Partway along the length of the nozzle body 12, the bore is shaped to define a region of diameter substantially equal to the diameter of the corresponding part of the needle 10 to guide sliding movement of the needle 10 with respect to the nozzle body 12. In order to permit fuel flow along this part of the bore, the valve needle 10 is provided with flutes. If desired, the dimensions of the flutes may be chosen to restrict the rate at which fuel flows towards the seating, in use.

The end of the nozzle body 12 remote from the blind end of the bore is in screw-threaded, sealing engagement with a nozzle holder 16 which includes an axially extending through bore which is coaxial with the bore provided in the nozzle body 12. The valve needle 10 extends through the bore of the nozzle holder 16, and a part of the bore of the nozzle holder 16 remote from the nozzle body 12 is of diameter substantially equal to the adjacent part of the valve needle 10 to guide sliding movement of the valve needle 10 and also to form a substantially fluid tight seal to restrict fuel flow between a control or spring chamber 18 defined between an end part of the valve needle 10, an end part of the bore of the nozzle holder 16 and a distance piece 20 which abuts the free end of the nozzle holder 16, and the remainder of the bore of the nozzle holder 16.

The distance piece 20 and a valve housing 24 are located within a large diameter bore formed in an elongate actuator housing 22, the distance piece 20 and valve housing 24 being secured in position by being trapped in the bore by the screw-threaded engagement of an end of the nozzle holder 16 within the bore of the actuator housing 22. As illustrated in FIG. 2, the distance piece 20 is provided with an angled drilling 26 which communicates with the spring chamber 18 and with drillings 28 provided in the valve housing 24. The drillings 28 communicate with an axially extending bore provided in the valve housing 24 within which a valve member 30 is slidable, the valve member 30 including a region of enlarged diameter arranged to engage a frusto-conical seating defined around a part of the bore to control fuel flow between the drillings 28 and a chamber 32 defined by an enlarged diameter portion of the bore of the valve housing 24. The chamber 32 houses a spring 34 which is engaged between the valve housing 24 and an enlarged diameter head 30*a* of the valve member 30 to bias the valve member 30 towards a position in which it does not engage its seating. The chamber 32 communicates through cross-drillings 36 with a series of axially extending grooves 38 provided in the outer surface of the valve housing 24, the grooves 38 communicating with similar grooves 40 provided in the outer periphery of the distance piece 20, the grooves 40 communicating, in turn, with a chamber defined between the actuator housing 22 and the nozzle holder 16 which communicates with a low pressure fuel reservoir. The face of the distance piece 20 which abuts the valve housing 24 is provided with a cross-slot 42 which communicates with the grooves 40 and is arranged to provide communication between the low pressure fuel reservoir and the lower end of the bore of the valve housing 24. This communication permits movement of the valve member 30 without generating a hydraulic lock.

As illustrated in FIG. 2, the spring chamber 18 houses a spring 44 which biases the valve needle 10 towards its seating. The valve needle 10 is provided with an axially extending drilling 46 which communicates with an angled drilling 48 both of which include regions of reduced diameter acting to restrict the flow of fuel through these drillings. In use, fuel is permitted to flow from the bore of the nozzle holder 16 through the drillings 46, 48 at a restricted rate to the spring chamber 18.

Adjacent the connection of the nozzle holder 16 to the actuator housing 22, the nozzle holder 16 is provided with a radially extending drilling 50 which is arranged to receive an end of a connector 52 whereby fuel is supplied from a suitable source of fuel at high pressure, for example a common rail charged with fuel by an appropriate high pressure fuel pump, to supply fuel at high pressure to the bore of the nozzle holder 16.

Figure 3:
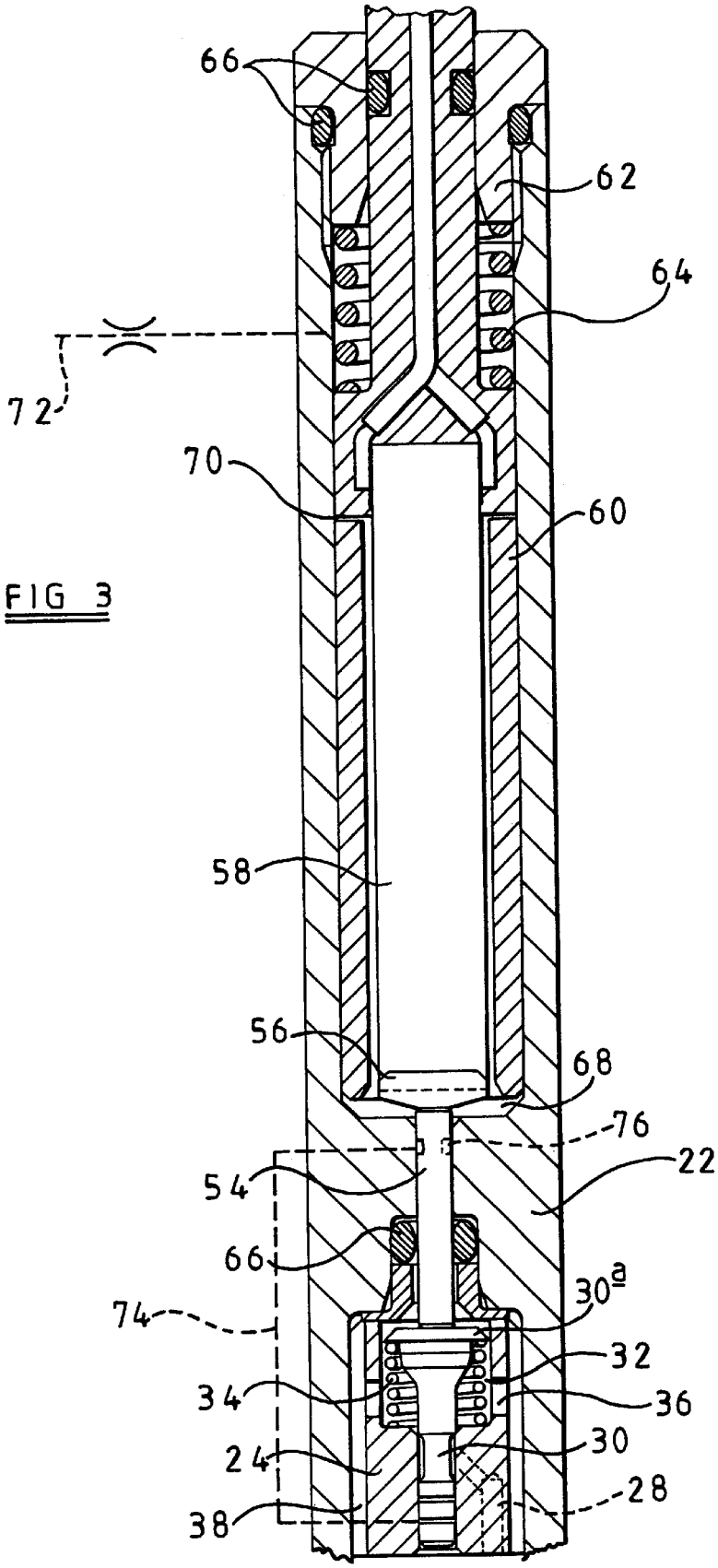
FIG. 3 is an enlargement of another part of FIG. 1.

As illustrated in FIG. 3, a rod 54 engages the end of the valve member 30, the rod extending through a reduced diameter bore provided in the actuator housing 22 and engaging an anvil member 56 mounted upon an end of a piezoelectric element 58. The piezoelectric element 58 is mounted within a piston 60 which is located within a large diameter bore provided in the actuator housing 22, the piston 60 extending from the end of the actuator housing 22 remote from the nozzle holder 16, and carrying electrical cables for use in controlling the electric field applied to the piezoelectric element 58. The end of the bore of the actuator housing 22 is closed by a screw-threaded cap 62, and a spring 64 is engaged between the cap 62 and a shoulder defined by part of the piston 60, the spring 64 biasing the piston 60, piezoelectric element 58, and rod 54 towards a position in which the valve member 30 engages its seating against the action of the spring 34.

O-ring seals 66 are provided between the cap 62 and piston 60, between the cap 62 and the actuator housing 22, and between the actuator housing 22 and rod 54. The bore of the actuator housing 22 within which the piezoelectric element 58 is located is filled with fluid, and the seals 66 prevent the fluid from escaping from the bore, but do not restrict axial movement of the rod 54 or piston 60. The piston 60 and bore of the actuator housing 22 within which the piston 60 is located together define a damping chamber 68 from which fluid is only permitted to escape at a restricted rate, the escaping fluid flowing between the piston 60 and actuator housing 22 to a part of the bore containing the spring 64. The presence of the fluid within the chamber 68 limits the rate at which the piston 60 can move under the action of the spring 64 to a relatively low rate.

In use, in the position illustrated, high pressure fuel is supplied through the connector 52 to the bore of the nozzle holder 16. Fuel at high pressure is therefore applied to surfaces of the needle 10 applying a force to the needle 10 acting in a direction to lift the needle 10 from its seating. High pressure fuel is also present in the spring chamber 18, and the action of the fuel within the spring chamber 18 in combination with the action of the spring 44 apply a force to the valve needle 10 acting in a direction to move the valve needle 10 acting in a direction to urge the valve needle 10 into engagement with its seating. The piezoelectric actuator is not energised, and the spring 64 urges the valve member 30 into engagement with its seating against the action of the spring 34. As the valve member 30 engages its seating, fuel is not permitted to escape from the spring chamber 18 past the valve member 30 and its seating to the low pressure fuel reservoir. The fuel pressure within the spring chamber 18 is therefore substantially equal to that within the bore of the nozzle holder 16, thus the force urging the valve needle 10 towards its seating is greater than that urging it away from its seating. The valve needle 10 therefore occupies a position in which it engages its seating, and injection is not occurring.

In order to commence injection, an electric field is applied across the piezoelectric element 58, the application of the electric field causing the width of the piezoelectric element 58 to increase, and as a result, the piezoelectric element 58 reduces in length. The reduction in the length of the piezoelectric element 58 is rapid, and although the piston 60 may move downwardly under the action of the spring 64 by a small amount, the presence of the fluid within the chamber 68 limits the rate at which the piston 60 can move to a sufficiently low rate that the spring 34 is permitted to lift the valve member 30 away from its seating. The movement of the valve member 30 permits fuel to escape from the spring chamber 18 thus reducing the fuel pressure applied to the end of the valve needle 10 located within the spring chamber 18. The reduction of fuel pressure within the spring chamber 18 permits the valve needle 10 to lift against the action of the spring 44, and injection commences. It will be appreciated that movement of the valve needle 10 away from its seating is limited by engagement of the end of the valve needle 10 with the distance piece 20. Once such engagement has occurred, although fuel will continue to flow through the passage 46 at a restricted rate to the low pressure fuel reservoir, the continued flow of fuel through the passage 48 at a restricted rate to the spring chamber 18 will result in the fuel pressure within the spring chamber 18 to increase. As, when the valve needle 10 occupies its fully lifted position, only part of the end of the valve needle 10 is exposed to the fuel pressure within the spring chamber 18, the force applied to the valve needle 10 at this time is not sufficient to cause movement of the valve needle 10 towards its seating.

In order to terminate injection, the electric field is no longer applied to the piezoelectric element 58, thus the piezoelectric element 58 returns to substantially its original length pushing the rod 54 and valve member 30 downward to return the valve member 30 into engagement with its seating. Once the valve member 30 engages is seating, the continued flow of fuel through the passage 46 results in the fuel pressure, and hence the force, applied to the valve needle 10 increasing to a sufficiently high level to cause the valve needle 10 to commence downward movement, returning into engagement with its seating and thus terminating injection. As the fuel pressure within the spring chamber 18 has already been increased as a result of fuel flowing through the passage 48, downward movement of the needle to terminate injection occurs rapidly. If the piston 60 moved downwards during injection, then the return of the piezoelectric element 58 to its original length returns the piston 60 to its original position, displacing fluid back to the chamber 68.

If, in use, the piezoelectric element 58 changes in length due to, for example changes in temperature or as a result of wear or drift, or if the position which the piezoelectric element 58 must occupy in order to cause the valve member 30 to engage its seating changes as a result of, for example, wear of the valve member 30 or seating which the valve member 30 engages, then these changes are compensated for by movement of the piston under the action of the spring 64. The presence of the fluid in the chamber 68 for damping movement of the piston 60 has little effect in compensating for such changes, as the changes occur relatively slowly.

In an alternative embodiment, the seal 66 between the rod 54 and actuator housing 22 may be omitted, the chamber 68 being supplied with fuel to damp movement of the piston 60. The fit of the rod 54 in the bore of the actuator housing 22 controls the flow of fuel to the chamber 68 and a restricted connection 72 to a low pressure fuel reservoir is provided to the chamber within which the spring 64 is located in order to allow fuel to escape between the piston 60 and the actuator housing 22 without pressurising the part of the bore containing the spring. The flow of fuel past the piston 60 assists in bleeding bubbles from the chamber 68. In this embodiment, the fuel pressure around the valve member 30 is increased, and if it is desired not to pressurize this part of the injector, an alternative arrangement is to supply the chamber 68 with fuel which leaks past the valve member 30 towards the chamber defined by the cross-slot 42, through a passage 74 illustrated schematically in FIG. 3. The passage 74 by-passes the seal 66 and communicates with an annular chamber 76 defined between the actuator housing 22 and the rod 54. In a further alternative, the passage 74 is provided to supply fuel to the chamber 68 as described hereinbefore, and the seal 66 is omitted. It will be appreciated that, in this arrangement, some fuel may flow from the chamber 76 towards the chamber 32. As described hereinbefore, the fuel in the chamber 68 acts to damp piston movement, fuel being displaced past the piston 60 in use escaping through the connection 72 to a low pressure reservoir.

In order to minimise oscillation of the piston, in use, the chamber 68 is conveniently of small volume, and no gas bubbles should be present in the fluid located with the chamber 68. The volume of the chamber 68 may be reduced by filling the space between the piezoelectric element 58 and piston 60 with an elastomeric component, and in this case, bubbles of gas should work their way between the piston 60 and actuator housing 22 to the chamber housing the spring 64. Alternatively, where fluid can flow between the piston 60 and the piezoelectric element 58, a plurality of small drillings 70 may be provided to allow bubbles to escape from the chamber 68.

Clearly, an advantage of the injector described hereinbefore is that the use of a piezoelectric actuator permits the diameter of the injector to be reduced. Further, the location of the passages 46, 48 in the needle 10 rather than in the adjacent part of the nozzle holder 16 permits the diameter of the injector to be reduced. An additional advantage of using a piezoelectric actuator is that by varying the amplitude of the voltage pulses applied thereto, the amount of change in the length of the piezoelectric element 58 can be controlled, thus controlling the lift of the valve member 30 from its seating. This has the advantage that the rate at which fuel can escape from the spring chamber 18 can be controlled, permitting greater control of the movement of the injector needle 10 and hence greater control of injection.

What is claimed is:

1. An injector comprising a valve needle slidable in a valve needle bore and moveable by controlling a force due to fuel pressure within a control chamber defined, in part, by a surface associated with the needle, and a piezoelectrically actuated control valve controlling the fuel pressure within the control chamber, wherein the piezoelectrically actuated control valve comprises a valve member moveable under the control of a piezoelectric actuator, said valve member being slidable within a bore and engageable with a valve seating defined by the bore to control fuel pressure within the control chamber, the piezoelectric actuator including a piezoelectric element spring biased towards the valve member by means of a first spring, the injector further comprising a rod interposed between the piezoelectric element and the valve member to transmit a force from the piezoelectric element to the valve member, and a damping arrangement damping movement of the piezoelectric element under the action of a force due to the first spring, the damping arrangement comprising a damping chamber for receiving a fluid, wherein the damping chamber is arranged between the piezoelectric element and the valve member and at least a portion of the rod extends through the damping chamber, the force due to the first spring being transmitted to the valve member by the piezoelectric element so as to urge the valve member towards a seated position, whereby when the valve member is in its seated position the injector is in a non fuel injecting state, the piezoelectrically actuated control valve being arranged such that a reduction in the length of the piezoelectric element causes initiation of fuel injection.

2. An injector as claimed in claim 1, wherein the damping arrangement comprises a piston member slidable within a piston bore, the piston member carrying the piezoelectric element.

3. An injector as claimed in claim 1, wherein the control chamber is supplied with fuel through a passage provided in the valve needle.

4. The fuel injector as claimed in claim 3, wherein the passage includes a region of restricted diameter serving to limit the rate at which fuel can flow towards the control chamber.

5. The fuel injector as claimed in claim 1, comprising a second spring which is arranged to urge the valve member away from the seated position into a non-seated position.

6. An injector comprising a valve needle slidable within a valve needle bore and movable by controlling a force due to fuel pressure within a control chamber defined, in part, by a surface associated with the needle, and a piezoelectrically actuated control valve controlling fuel pressure within the control chamber, wherein the piezoelectrically actuated control valve comprises a valve member moveable under the control of a piezoelectric actuator, said valve member being slidable within a bore and engageable with a valve seating defined by the bore to control fuel pressure within the control chamber, the piezoelectric actuator including a piezoelectric element spring biased towards the valve member, the injector further comprising a rod interposed between the piezoelectric element and the valve member for transmitting a force from the piezoelectric element to the valve member, and a damping arrangement damping movement of the piezoelectric element under the action of the spring, the damping arrangement comprising a damping chamber for receiving a fluid, the damping chamber being arranged between the piezoelectric element and the valve member and at least a part of the rod extending through the damping chamber, the damping arrangement further comprising a piston member slidable within a piston bore, the piston member carrying the piezoelectric element, wherein fluid is able to flow along the piston bore past the piston member at a restricted rate.

* * * * *